US011437208B2

(12) United States Patent
Zuniga

(10) Patent No.: US 11,437,208 B2
(45) Date of Patent: Sep. 6, 2022

(54) ELECTRICAL SWITCH WITH IDENTIFICATION FEATURES

(71) Applicant: Melissa Zuniga, Brooklyn Park, MN (US)

(72) Inventor: Melissa Zuniga, Brooklyn Park, MN (US)

( * ) Notice: Subject to any disclaimer, the term of this patent is extended or adjusted under 35 U.S.C. 154(b) by 0 days.

(21) Appl. No.: 17/250,018

(22) PCT Filed: May 3, 2019

(86) PCT No.: PCT/US2019/030603
§ 371 (c)(1),
(2) Date: Nov. 3, 2020

(87) PCT Pub. No.: WO2019/213523
PCT Pub. Date: Nov. 7, 2019

(65) Prior Publication Data

US 2021/0383990 A1 Dec. 9, 2021

Related U.S. Application Data

(60) Provisional application No. 62/666,474, filed on May 3, 2018.

(51) Int. Cl.
*H01H 21/22* (2006.01)
*H01H 21/02* (2006.01)

(52) U.S. Cl.
CPC ..... *H01H 21/22* (2013.01); *H01H 21/025* (2013.01)

(58) Field of Classification Search
CPC ..... H01H 2219/002; H01H 2219/006; H01H 2219/008; H01H 2219/01;
(Continued)

(56) References Cited

U.S. PATENT DOCUMENTS 3,250,887 A 5/1966 Sorenson
3,928,743 A 12/1975 Ohashi
(Continued)

FOREIGN PATENT DOCUMENTS

DE 3436172 A 4/1986
WO WO 2019/213523 11/2019
WO WO 2020/237187 11/2020

OTHER PUBLICATIONS

International Search Report and Written Opinion, International Application No. PCT/US2020/034323, dated Aug. 19, 2020, 13 pages.

(Continued)

*Primary Examiner* — Lheiren Mae A Caroc
(74) *Attorney, Agent, or Firm* — Patterson Thuente Pedersen, P.A.

(57) ABSTRACT

An electrical switch with identifying features. Embodiments include a toggle assembly for an electrical switch that comprises a switch body including a contact mechanism configured to control an electrical circuit. A movement of the toggle assembly from a first position to a second position is mechanically communicated to the contact mechanism. The toggle assembly can also include a user-operable actuator portion elongated between the switch engagement portion and a front end of the toggle assembly enabling a user to pivot the toggle assembly from the first position to the second position. Embodiments include an interchangeable tile removably coupleable to the toggle. The interchangeable tile can comprise an identifier. Embodiments include an illuminating element and a cover.

15 Claims, 14 Drawing Sheets

(58) Field of Classification Search
CPC ..... H01H 2219/014; H01H 2219/018; H01H 2219/022; H01H 2219/036; H01H 2219/037; H01H 2219/04; H01H 2219/042; H01H 21/22; H01H 21/025; H01H 23/025; H01H 23/24; H01H 21/00; H01H 23/00; H01H 21/02
USPC ..... 200/308–313, 315
See application file for complete search history.

(56) References Cited

U.S. PATENT DOCUMENTS

| | | | | |
|---|---|---|---|---|
| 4,234,774 | A | | 11/1980 | Paparella |
| 4,479,170 | A | * | 10/1984 | Richardson ..... H01H 23/025 200/315 |
| 4,556,863 | A | * | 12/1985 | Devitt ..... B60Q 1/52 200/310 |
| 5,008,503 | A | | 4/1991 | Stuhlmacher |
| 6,013,885 | A | | 1/2000 | Kowalczyk |
| 7,329,018 | B2 | | 2/2008 | Yu et al. |
| 8,253,049 | B2 | | 8/2012 | Grisby |
| 8,338,731 | B2 | | 12/2012 | Yu |
| 8,592,681 | B2 | | 11/2013 | Alderson et al. |
| 8,822,859 | B2 | | 9/2014 | Hoffman et al. |
| 9,082,569 | B2 | | 7/2015 | Alderson et al. |
| 10,607,797 | B2 | | 3/2020 | Zuniga |
| 2004/0218379 | A1 | | 11/2004 | Barton |
| 2007/0216318 | A1 | | 9/2007 | Altonen et al. |
| 2010/0170773 | A1 | | 7/2010 | Grisby |
| 2014/0097070 | A1 | | 4/2014 | McDonnell |
| 2014/0151203 | A1 | | 6/2014 | Gouhl et al. |
| 2014/0265883 | A1 | | 9/2014 | Mortun |
| 2016/0035508 | A1 | | 2/2016 | Murata |
| 2018/0137999 | A1 | | 5/2018 | Zuniga |
| 2019/0074676 | A1 | | 3/2019 | Beghelli |

OTHER PUBLICATIONS

Application and File History for U.S. Appl. No. 15/813,822, filed Nov. 15, 2017, Inventor Melissa Zuniga.
International Search Report and Written Opinion, International Application No. PCT/US2019/030603, dated Jul. 17, 2018, 12 pages.
Application and File History for U.S. Appl. No. 17/250,046, filed Nov. 12, 2020, Inventor Melissa Zuniga.

* cited by examiner

ELECTRICAL SWITCH WITH IDENTIFICATION FEATURES

CROSS-REFERENCE TO RELATED APPLICATIONS

This application is a national stage entry of International Application No. PCT/US2019/030603, filed May 3, 2019, which claims the benefit of U.S. Provisional Application No. 62/666,474, filed May 3, 2018, the disclosure of which is incorporated by reference herein.

TECHNICAL FIELD

Embodiments of the present disclosure relate generally to the field of electrical switches, specifically electrical switches adapted for use in building wiring.

BACKGROUND

In many building environments, lights, electrical outlets, and other devices are controlled by a series of electrical switches, often referred to as "light switches." For convenience, these switches are often arranged on panels with two or more switches in close proximity. Individual switches on panels are often generic, leading to user confusion regarding which electrical device(s) are controlled by any particular switch.

A variety of labeling options for switch plates exist, ranging from permanently labeled plates to removable adhesive labels. However, in many environments, switch plate designs are decorative, and labels incorporated into switch plates can be intrusive.

A need exists therefore, for electrical switches that enable identification of the electrical device(s) and/or circuits that they are configured to control.

SUMMARY

Embodiments of the present disclosure include light switches with identifying labeling. In embodiments, a user facing surface of an electrical switch includes an identifying symbol on an interchangeable tile.

Embodiments of the present invention include a toggle assembly for an electrical switch that comprises a switch body including a contact mechanism configured to control an electrical circuit. The toggle assembly can comprise a switch engagement portion proximate and operably coupled to the switch body at a rear end of the toggle assembly, such that a movement of the toggle assembly from a first position to a second position is mechanically communicated to the contact mechanism. The toggle assembly can also include a user-operable actuator portion elongated between the switch engagement portion and a front end of the toggle assembly enabling a user to pivot the toggle assembly from the first position to the second position. Embodiments include an interchangeable tile removably coupleable to the actuator portion at the front end of the toggle assembly. The interchangeable tile can comprise a user-comprisable identifier on a front surface of the interchangeable tile, such that the interchangeable tile indicates a property, such as the intended function, of the electrical circuit controlled by the electrical switch. The interchangeable tile can at least partially comprise a light-transmitting material, such that a light generated by the illuminating element can be seen at a front surface of the interchangeable tile when the interchangeable tile is coupled to the actuator portion.

In embodiments, the toggle assembly comprises a cover adapted to be removably coupleable about a front portion of the actuator portion, such that the interchangeable tile is arranged within the cover behind a front surface of the cover when the cover is coupled to the actuator portion. The front surface of the cover can be comprised of a light-transmitting material. A top surface, a bottom surface, a right side surface and a left side surface of the cover can be comprised of an opaque material, or a light-transmitting material.

In embodiments, the front surface of the cover is connected to a bottom surface of the cover that extends further forward from the actuator portion than a top surface of the cover, such that the front surface of the cover is presented at an upward facing angle when the cover is coupled to the actuator portion. In embodiments, the front surface of the interchangeable tile is presented at an upward facing angle when the interchangeable tile is coupled to the actuator portion.

In embodiments, the interchangeable tile comprises a connection mechanism at a rear surface of the interchangeable tile and the actuator portion comprises a receiving mechanism at a front surface of the actuator portion. The connection mechanism and the receiving mechanism can be configured to provide removable fixation between the interchangeable tile and the actuator portion.

In embodiments, the connection mechanism can be a rearward directed pin, and the receiving mechanism comprises a slot of a diameter sufficient to receive the pin. In embodiments, the connection mechanism can be a rearward directed threaded screw, and the receiving mechanism comprises a threaded bore configured to receive the screw. In embodiments the connection mechanism can include one or more flanges extending along an axis parallel to the front surface of the connection mechanism, and the receiving mechanism comprises one or more grooves configured to receive the one or more flanges.

In embodiments, the toggle assembly an also include an illuminating element, such as a light-emitting diode (LED). In embodiments, a conductive trace can electrically couple the illuminating element to the electrical circuit controlled by the electrical switch, such that the illuminating element is powered by the electrical circuit. In embodiments, a power source independent of the electrical circuit can power, such that the illuminating element is powered by the power source. In embodiments, the interchangeable tile is at least partially made of a light-transmitting material, such that light generated by the illuminating element can be seen at a front surface of the interchangeable tile. The actuator portion can be made of an opaque material, such that light generated by the illuminating element cannot be seen through the actuator portion.

In embodiments, the illuminating element can comprise a circuit board comprising a light emitting diode, and the switch engagement portion of the toggle assembly can comprise a toggle insert adapted to receive the illuminating element and to engage with a rear portion of the actuator portion of the toggle assembly.

In another aspect, embodiments of the present disclosure include an electrical switch to control an electrical circuit. The electrical switch can include a switch body comprising a first terminal for electrical connection to a first lead of the electrical circuit, a second terminal for electrical connection to a second lead of the electrical circuit, a contact mechanism including a contact point electrically coupled to the first terminal, a lever arm electrically coupled to the second terminal. The lever arm can be manipulable to selectively contact the contact point. The switch can also include a toggle assembly including a switch engagement portion proximate and operably coupled to the switch body at a rear end of the toggle assembly, such that when the toggle assembly is in a first position the lever arm is not in contact with the contact point, and when the toggle assembly is in a second position, the lever arm is in contact with the contact point. The toggle assembly can also include a user-operable actuator portion elongated between the switch engagement portion and a front end of the toggle assembly enabling a user to pivot the toggle assembly from the first position to the second position, an illuminating element, and an interchangeable tile removably coupleable to the actuator portion at the front end of the toggle assembly the interchangeable tile at least partially comprising a light-transmitting material, such that a light generated by the illuminating element can be seen at a front surface of the interchangeable tile when the interchangeable tile is coupled to the actuator portion.

In another aspect, embodiments of the present disclosure can include a kit for providing an indication of a function of an electrical switch. The kit can include an electrical switch with a switch body including a contact mechanism configured to control an electrical circuit, a toggle, and a plurality of interchangeable tiles. The toggle can be pivotable between a first position and a second position, and operably coupled to the switch body at a rear end of the switch body and include a user-operable actuator portion extending from the rear end to a front end of the toggle. The toggle can further comprise an illuminating element. Each interchangeable tile removably coupleable to the actuator portion at the forward end of the toggle.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures.

Figure 1:
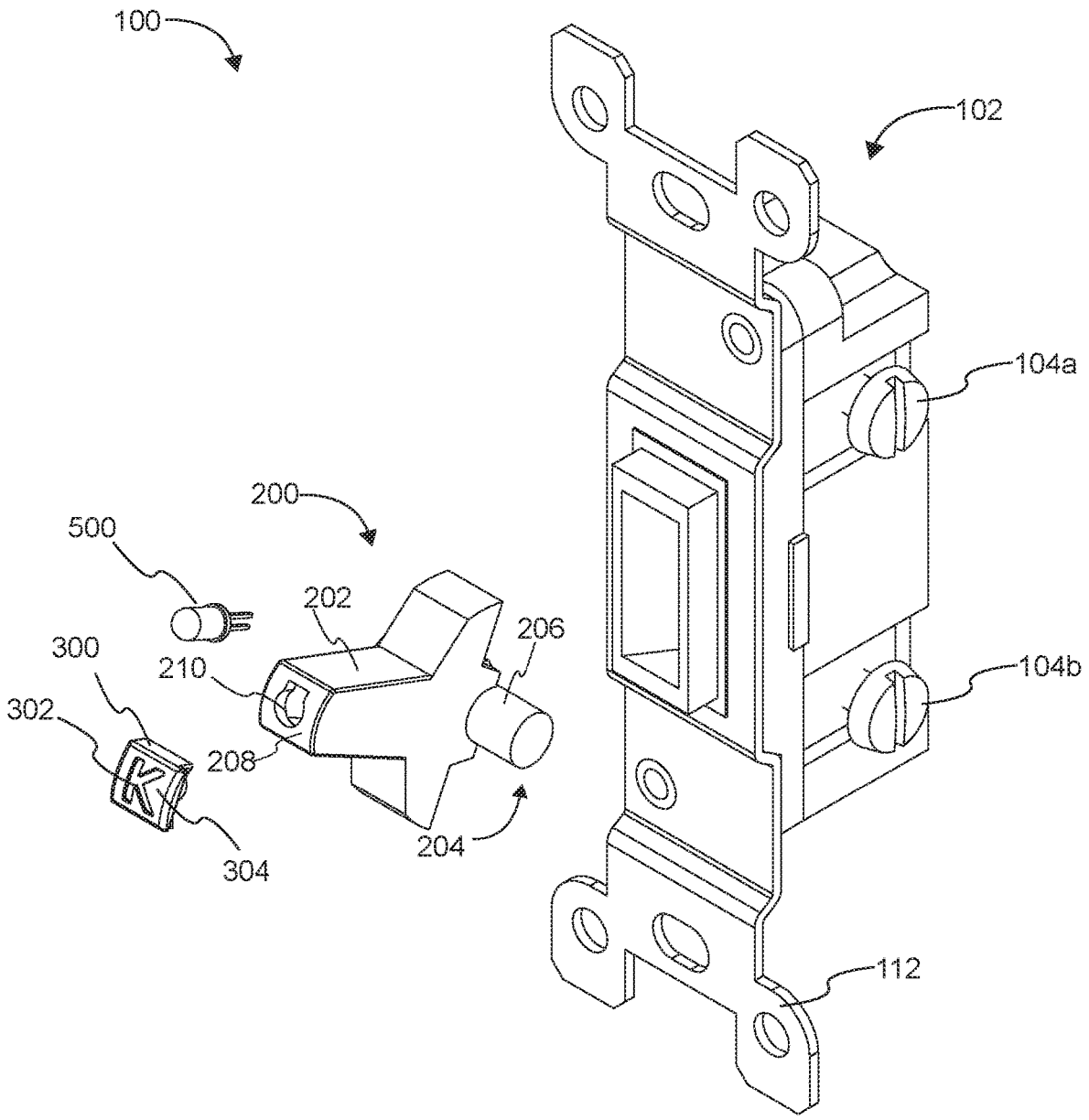
FIG. 1 is an exploded perspective view depicting an electrical switch, according to an embodiment.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

FIG. 1 is an exploded perspective view of an embodiment of an electrical switch 100. Electrical switch 100 includes toggle 200, which is operably coupleable to interchangeable tile 300. In embodiments tile 300 and toggle 200 can be combined into a toggle assembly. Light switch 100 can enable a user to control an electrical circuit via manipulation of toggle 200. In embodiments, the electrical circuit can include one or more lighting devices, electrical outlets, other devices, or combinations of these. Various embodiments of switches, toggles, toggle assemblies and other components are depicted herein. Similar reference numbers are used to refer to similar component across the various embodiments. As described herein, references to a rear, rearward, or back end or surface of a component generally indicate the direction away from the user when the switch 100 or other components are installed. In other words, the "rear" can be considered to be the direction toward the wall. Further, references to a "front" or "forward" direction are intended to refer to the direction facing away from the wall toward the user when the switch is installed.

Switch 100 can comprise switch body 102. Switch body 102 can have form, dimensions, materials, and structure similar to conventional electrical switches capable of receiving toggle 200. Switch body 102 can comprise two or more terminals 104 for connection to leads of an electrical circuit. As depicted herein, switch 100 is a single-pole light switch including terminals 104*a* and 104*b* for connection to electrical wiring. Embodiments of light switch 100 can be three-way or four-way switches, and may include more terminals 104, including one or more grounding terminals in order to support environments in which multiple switches may control an electrical circuit.

Figure 2A:
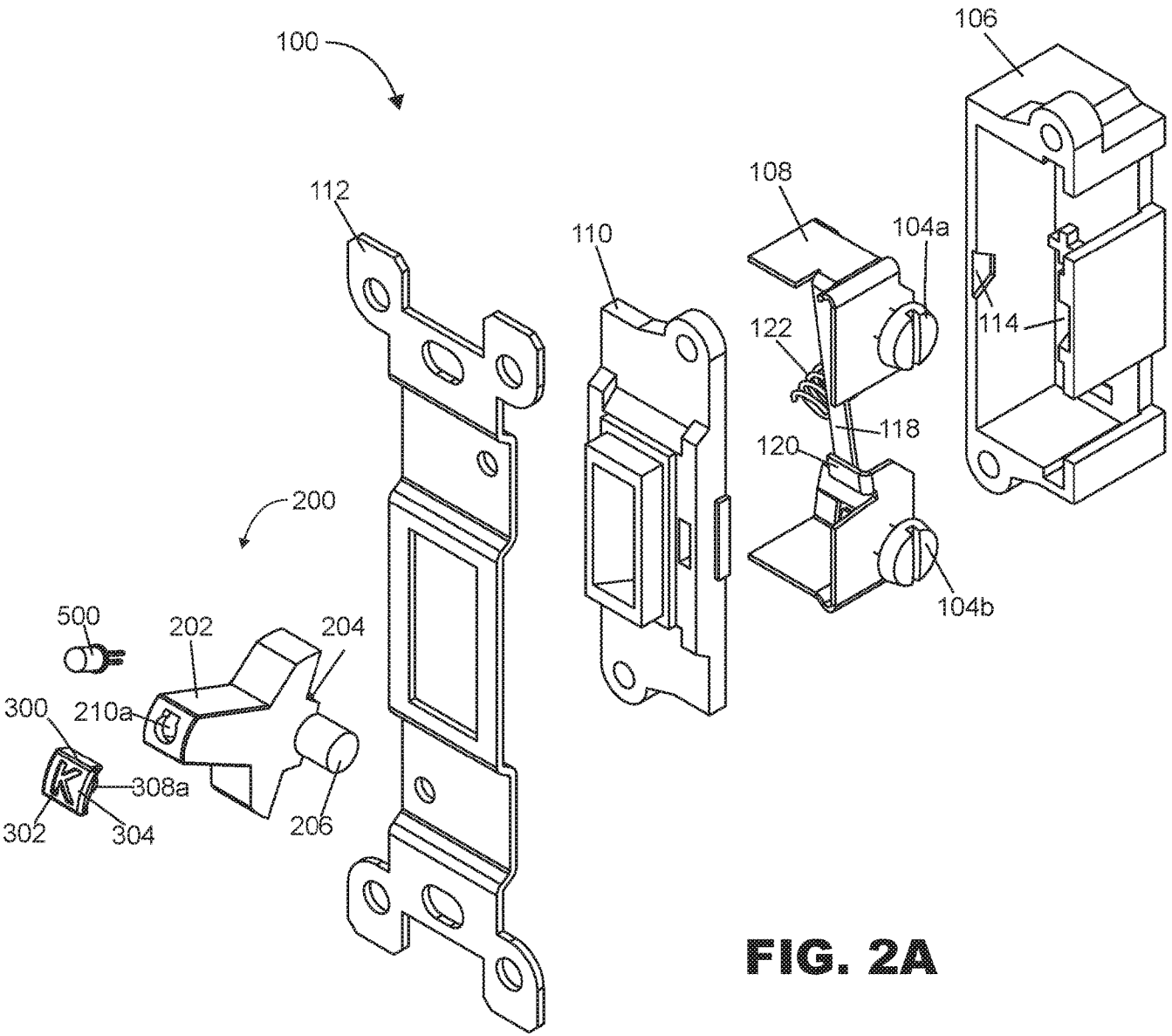
FIG. 2A is an exploded perspective view depicting the electrical switch of FIG. 1.
Figure 2B:
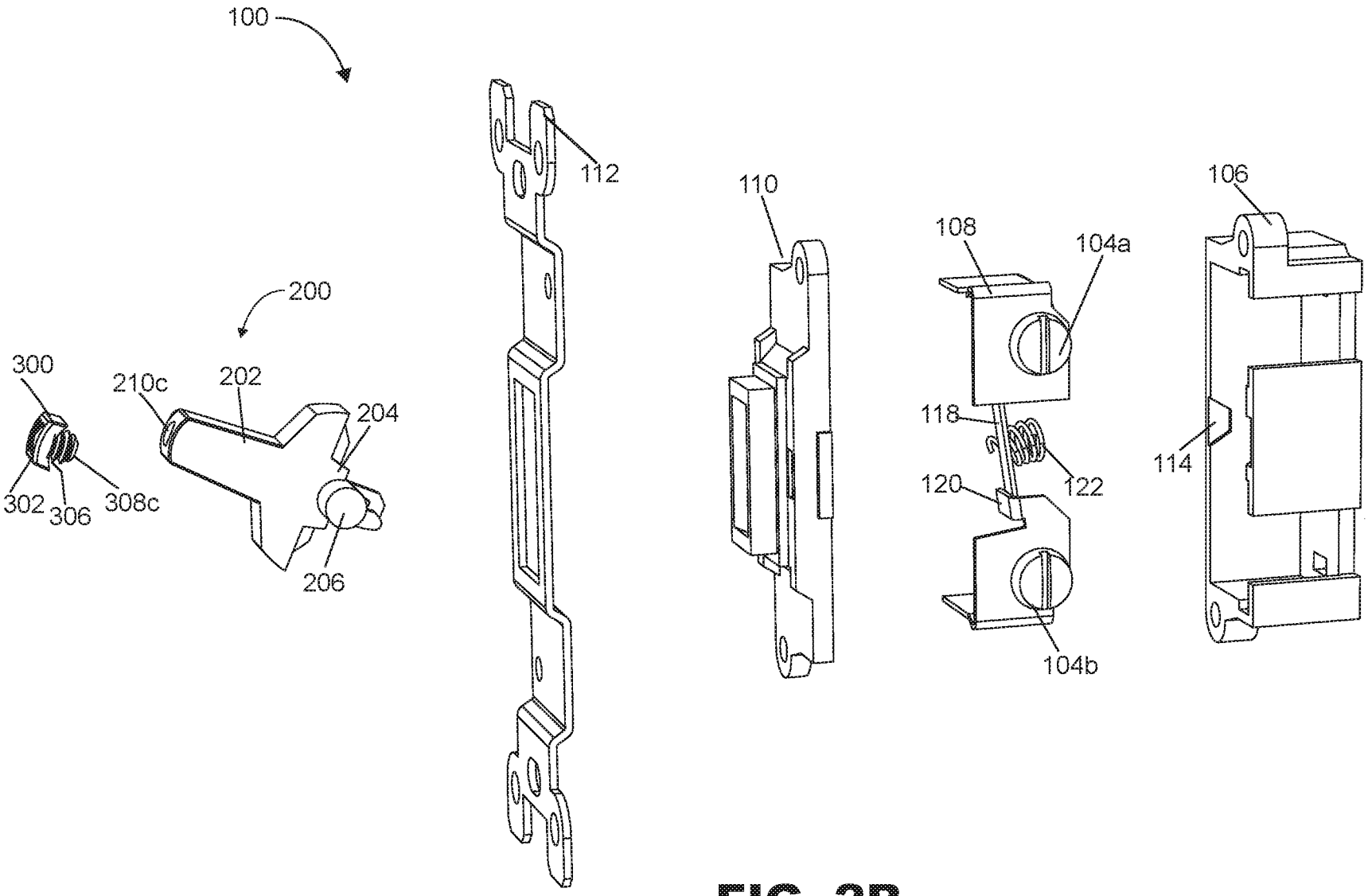
FIG. 2B is an exploded perspective view depicting an electrical switch, according to an embodiment.
Figure 3B:
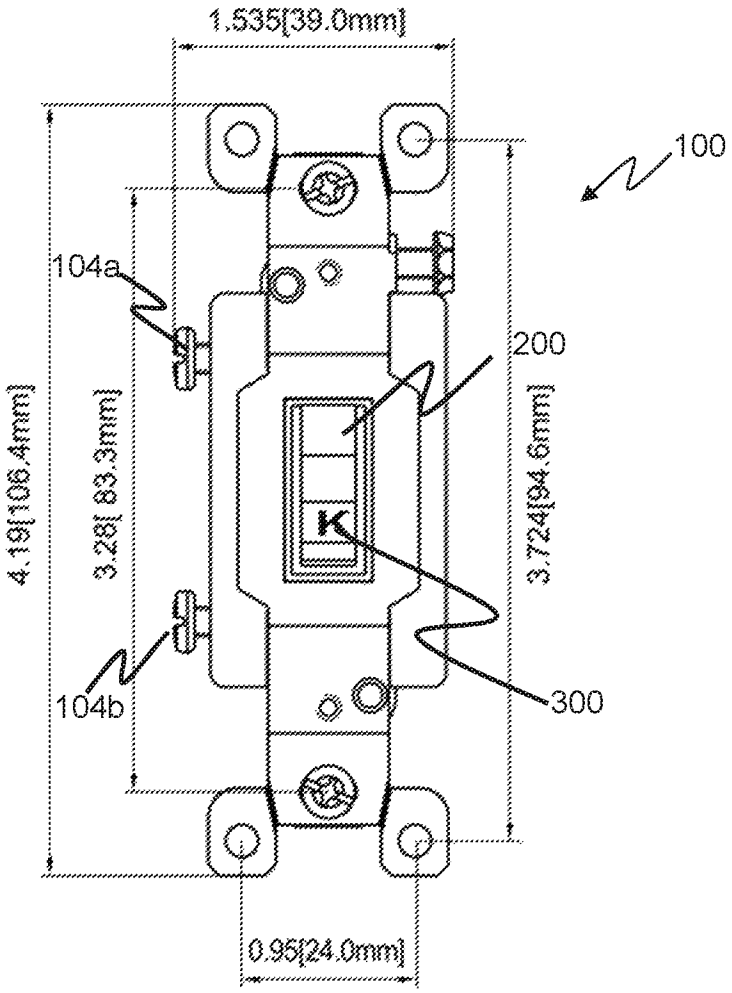
FIG. 3B is a front plan view depicting the electrical switch of FIG. 3A.
Figure 3A:
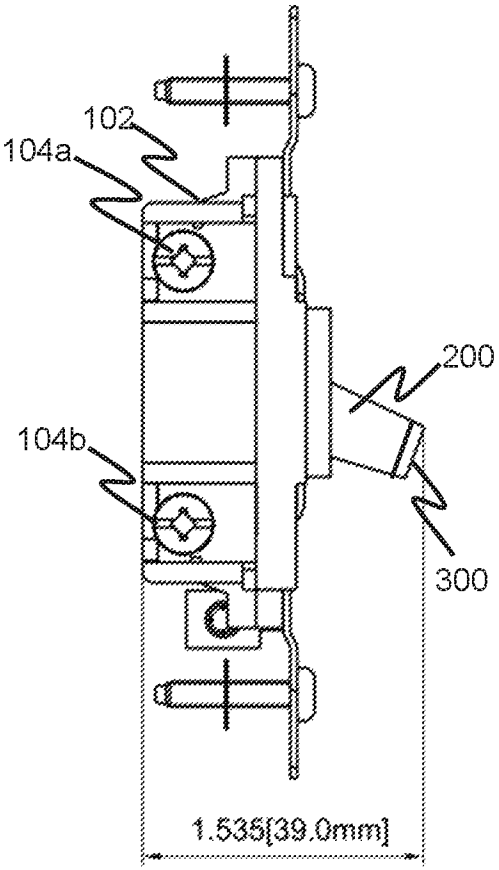
FIG. 3A is a side plan view depicting an electrical switch, according to an embodiment.

FIGS. 2A and 2B are exploded perspective views of switch 100, according to an embodiment. In the depicted embodiment, switch body 102 further comprises housing 106, contact assembly 108, guard plate 110 and mounting plate 112. In embodiments, switch body 102 can have dimensions according to those depicted in FIGS. 3A and 3B. Those of ordinary skill in the art will appreciate that the configuration of switch body 102 depicted and described herein is a particular example, and various alternative configurations can be used, especially those adapted to applicable local electrical standards or codes.

Housing 106 can comprise pivot cradles 114. Contact assembly 108 can comprise contact mechanism 116 to selectively electrically couple one or more terminals 104. In an embodiment, contact mechanism 116 can comprise a lever arm 118 operatively coupled to a first terminal 104*a* and a contact point 120 operably coupled to a second terminal 104*b*. Lever arm 118 can be spring-loaded, flexible, or otherwise manipulable such that inward pressure on lever arm 118 can break contact between lever arm 118 and contact point 120. Contact assembly can further comprise spring 122. Those of ordinary skill in the art will recognize that other configuration of contact mechanism 116 can be used.

Toggle 200 can comprise user-operable actuator portion (or simply, actuator) 202 and switch engagement portion 204. Switch engagement portion 204 can comprise one or more pivot pins 206, enabling a front end 208 of toggle 200 to pivot in an arc (centered at pivot pins 206) from a first position to a second position within switch body 102 by movement of user-operable actuator portion 202. Switch engagement portion 204 can further comprise one or more features, such as a ram, button, piston, protrusion, or other, configured to selectively engage a contact mechanism (see FIG. 2A) of switch body 102. User-operable actuator portion 202 can comprise receiving mechanism 210 to receive interchangeable tile 300.

As assembled, pivot pins 206 can engage with pivot cradles 114 such that actuator portion 202 extends forward through contact assembly 108, guard plate 110, and mounting plate 112. Actuator portion 202 can project outward from switch body 102 for a length of about 19/32 inches, though other lengths can be used.

Figure 4B:
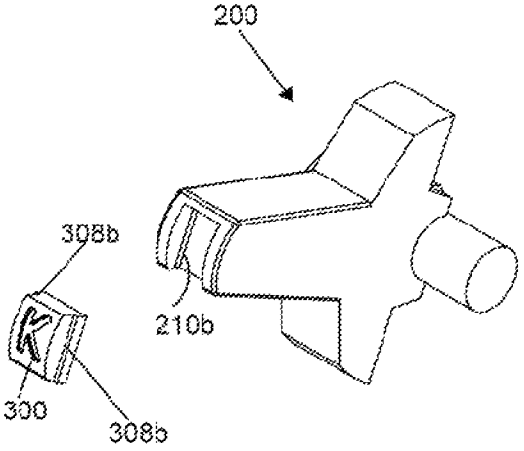
FIG. 4B is an exploded perspective view depicting a toggle, according to an embodiment.
Figure 4C:
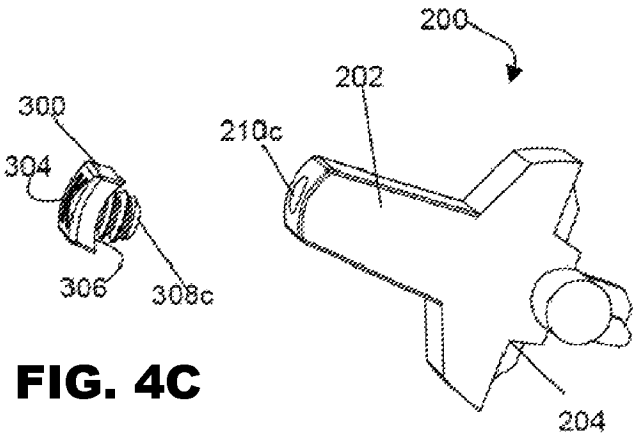
FIG. 4C is an exploded perspective view depicting a toggle, according to an embodiment.
Figure 4A:
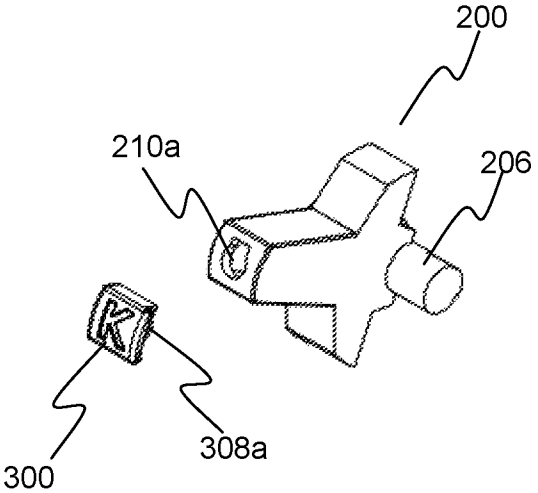
FIG. 4A is an exploded perspective view depicting a toggle, according to an embodiment.

FIGS. 4A-4E are exploded perspective views depicting embodiments of toggle 200 including various connection methods between tile 300 and toggle 200. Tile 300 can comprise a connection mechanism 308, configured to engage with a receiving mechanism 210 of toggle 200. As depicted in FIG. 4A, receiving mechanism 210 comprises structure of toggle 200 defining a slot 210*a* of size and shape (such as width, diameter, length, height, or other dimension) to receive connection mechanism 308 which comprises a pin 308*a*. Pin 308*a* and slot 210*a* can comprise keyed structures, such that tile 300 is limited to a particular orientation when coupled to toggle 200.

In an embodiment depicted in FIG. 4B, tile 300 comprises flanges 308*b*, configured for slideable engagement with grooves 210*b* of toggle 200. Grooves 210*b* can, as depicted, extend partially along a surface of toggle 200 at front end 208, such that flanges 308*b* are prevented from sliding out of grooves 210*b*. Grooves 210*b* are depicted such that tile 300 is inserted from a bottom end of switch 100, however in embodiments, grooves 210*b* and flanges 308*b* can be arranged such that tile 300 is inserted from a bottom, top, left, or right side of toggle 200. FIG. 4C depicts tile 300 comprising threaded pin or screw 308*c*. Toggle 200 can comprise coordinating threaded bore 210*c*. Tile 300 can be rotated by a user such that screw 308*c* engages bore 210*c* to removably couple tile 300 to toggle 200.

Figure 4D:
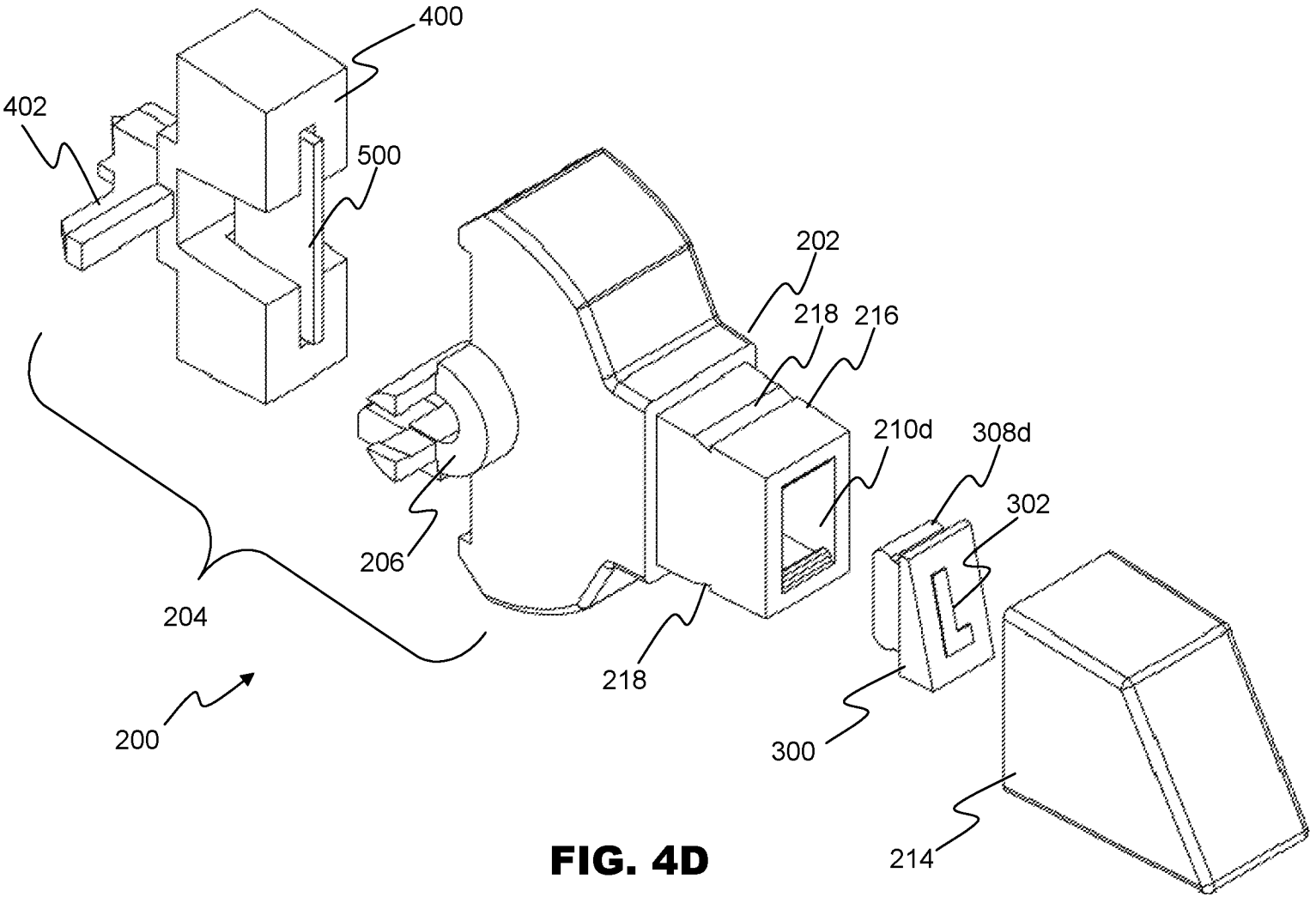
FIG. 4D is an exploded perspective view depicting a toggle, according to an embodiment.
Figure 4E:
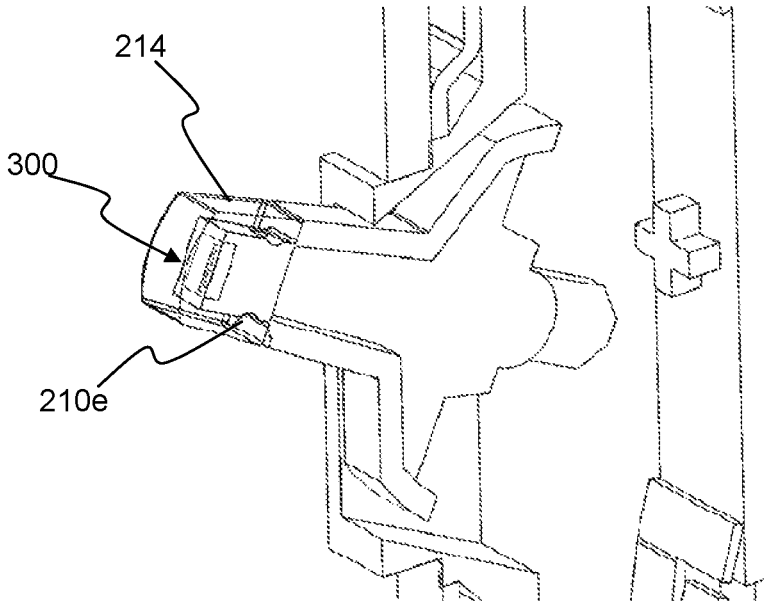
FIG. 4E is a sectional perspective view depicting a toggle, according to an embodiment.
Figure 5A:
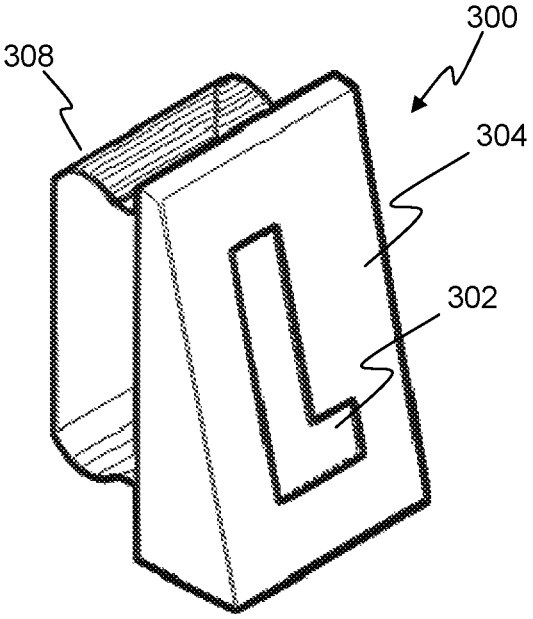
FIG. 5A is a perspective view depicting an interchangeable tile, according to an embodiment.
Figure 5B:
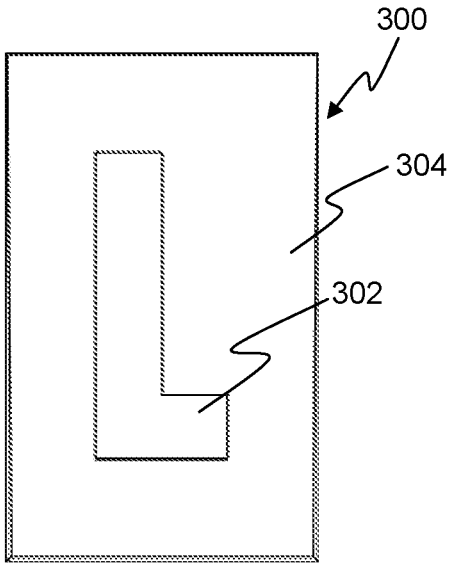
FIG. 5B is a front plan view depicting the interchangeable tile of FIG. 5A.
Figure 5C:
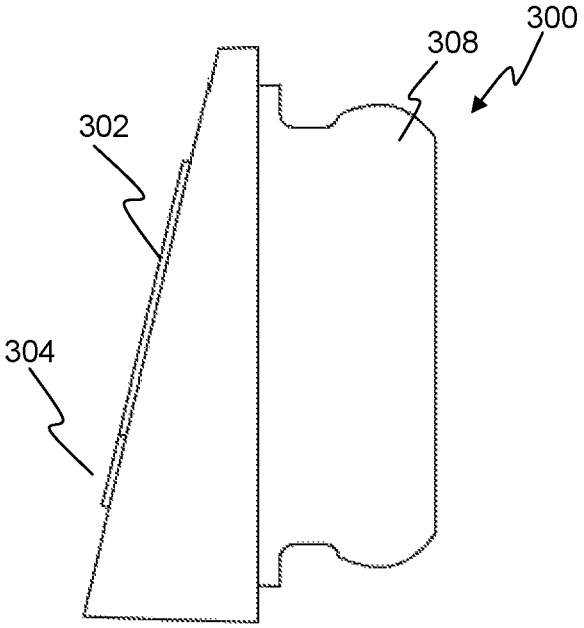
FIG. 5C is a side plan view depicting the interchangeable tile of FIG. 5A.
Figure 5D:
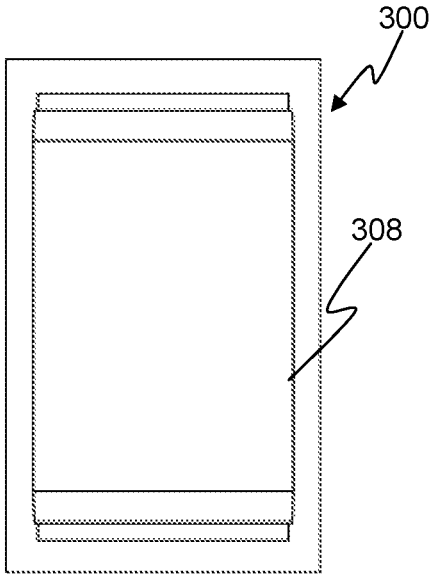
FIG. 5D is a bottom plan view depicting the interchangeable tile of FIG. 5A.
Figure 6A:
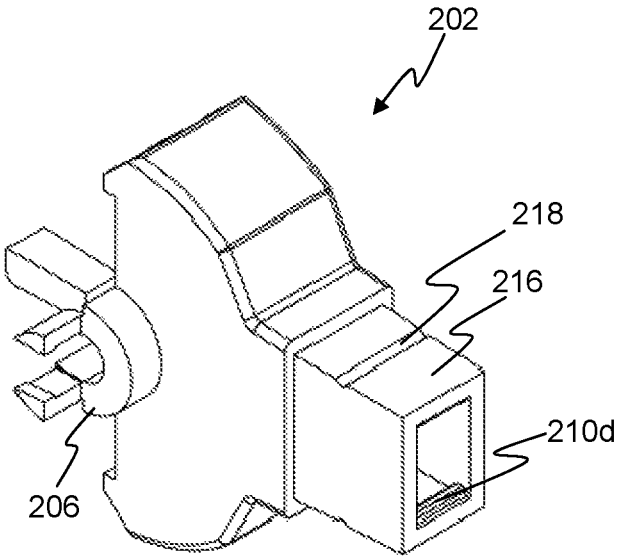
FIG. 6A is a perspective view depicting a portion of a toggle, according to an embodiment
Figure 6B:
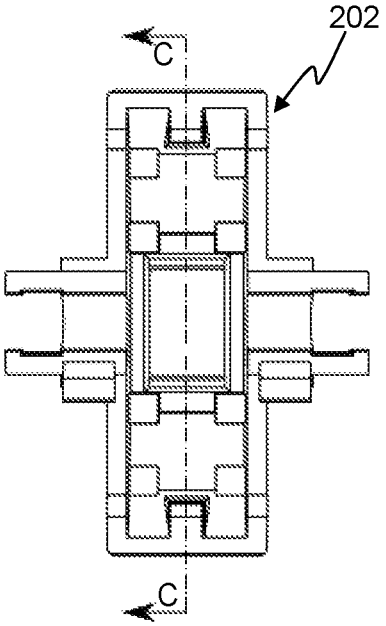
FIG. 6B is a rear plan view depicting the portion of the toggle of FIG. 6A.
Figure 6C:
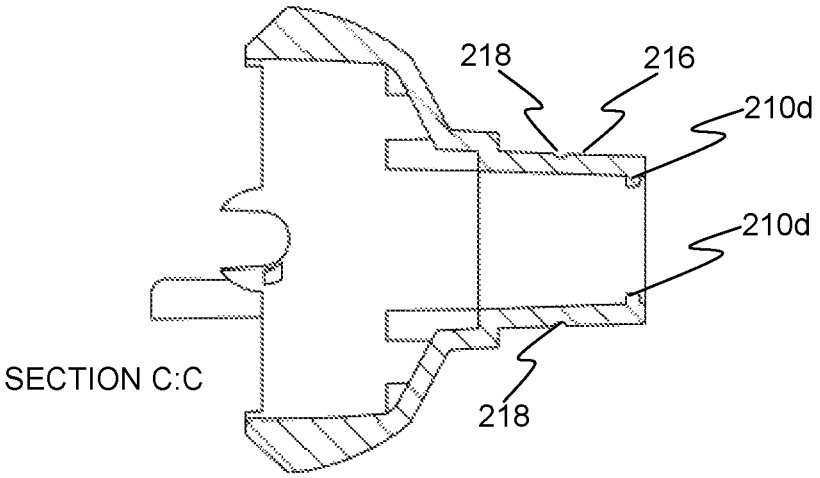
FIG. 6C is a section view depicting the portion of the toggle of FIG. 6A.

FIG. 4D depicts still another embodiment of toggle 200. As depicted, tile 300 comprises flanges 308*d* configured to be received within a bore including protrusions 210*d*, as discussed below with respect to FIGS. 6A-6C. The toggle 200 of FIG. 4D further comprises a cover 214. Cover 214 can be entirely or partially transparent or translucent such that user-comprisable identifier 302 can be seen through at least a front portion of cover 214. Cover 214 can be configured to slide over and around a post 216 of actuator portion 202, and can be engaged by cover connection mechanism, which can comprise indentations or grooves 218 defined in post 216. FIG. 4E depicts tile 300 comprising a cover 214. Cover 214 is configured to extend along toggle 200 towards switch body 102. Receiving mechanism 210 can comprise a conventional toggle tip, or textured material to provide additional engagement with cover 214. In embodiments, cover 214 can be constructed of an elastomeric material such as silicone or latex, and can be stretched to fit over toggles of one or more sizes and configurations. Front surface 214 can comprise a label, sticker, decal, or other interchangeable decorative element. As described above, front surface 304 can be partially transparent or translucent to enable transmission of light through user-comprisable identifier 302.

In embodiments, connection mechanism 308 and receiving mechanism 210 can be removably affixed via pressure, or friction, fit between corresponding components. In alternative embodiments, each of connection mechanism 308 and receiving mechanism 210 can further comprise compatible adhesive surfaces. Adhesive surfaces can comprise temporary removable adhesives or permanent adhesives in embodiments.

While multiple connection mechanisms 308 and receiving mechanisms 210 are depicted and described herein, those of ordinary skill in the art will recognize that other connection methods can be used, including male and female snap connectors, hook-and-loop connectors, magnetic connectors or any other connectors enabling removable or permanent connection between tile 300 and toggle 200.

FIGS. 5A-5D are views depicting an interchangeable tile 300, according to an embodiment. Interchangeable tile 300 can be permanently or removably coupleable to user-operable actuator portion 202. Interchangeable tile 300 can comprise a user-comprisable identifier 302 on a front surface 304. User-comprisable identifier 302 is depicted as the letters "K" or "L" herein, but can comprise, any letter, number, character, pictogram, icon, other symbol, pattern, color, or other marker or identifier capable of assisting in identification. In embodiments, tile 300 can comprise a material that temporarily or permanently markable with various substances including permanent ink, dry-erase ink, chalk, graphite, crayon, or other mark-making material.

In embodiments, tile 300 can present a square cross section, with a length and width between about ⅛ inches and about ⅜ inches. In embodiments, tile 300 can present a cross section of alternative shape or dimensions, including a shape coordinated with front end 208 of toggle 200. Tile 300 can have a rear surface 306 configured to correspond to the front end 208 of toggle 200. Front end 208 and rear surface 306 can be substantially curved, flat, angled, smooth, rough, or present other shapes or textures as desired. Further front surface 304 can be angled upward to improve comprisability of identifier 302.

In embodiments, identifier 302 can be molded into front surface 304 of tile 300. Identifier 302 can be raised into a high relief or sunken into bas-relief relative to front surface 304, in embodiments. In embodiments, identifier 302 may present as an aperture or bore extending from front surface 304 to rear surface 306 of interchangeable tile 300. Identifier 302 can further comprise a translucent or transparent portion of front surface 304, such that light can be transmitted through identifier 302.

Connection mechanism 308 can comprise a compliant material, such as a rubberized polymer, such that the flanges, if present, can deform to engage around pins, slots, protrusions, or other elements of receiving mechanism 210.

FIGS. 6A-6D depict an actuator 202 of a toggle 200, according to an embodiment. Receiving mechanism 210 can comprise a bore defined within a front end of actuator 202, and protrusions 210*d* can extend inwardly to engage with connection mechanism 308. Actuator 202 can further be configured to accept toggle insert 400 (as describe in more detail with respect to FIGS. 8A and 8B below). For example, actuator 202 can present a bore or other opening at a rear end, proximate pivot pins 206, enabling insertion of toggle insert 400. Actuator 202 can present a cover receiving mechanism that can comprise a post 216, and one or more indentations or grooves 218, for engagement with a cover connection mechanism.

Figure 7A:
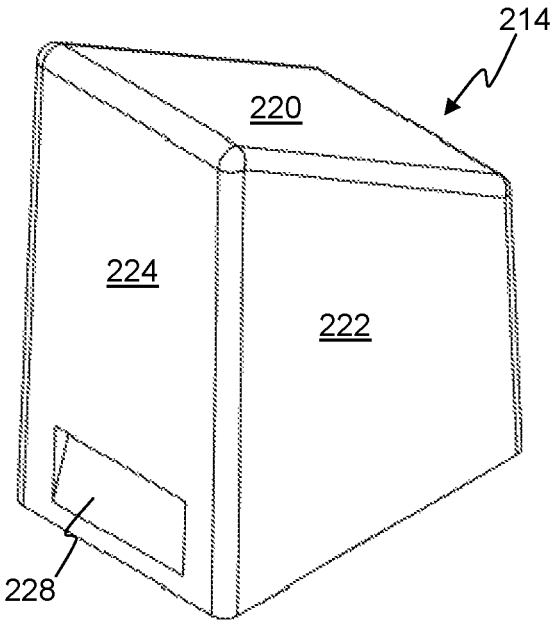
FIG. 7A is a perspective view depicting a cover, according to an embodiment.
Figure 7B:
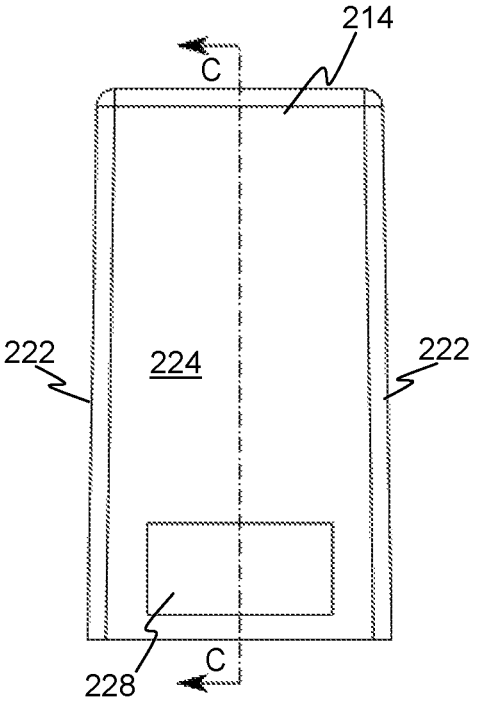
FIG. 7B is a rear plan view depicting the cover of FIG. 7A.
Figure 7C:
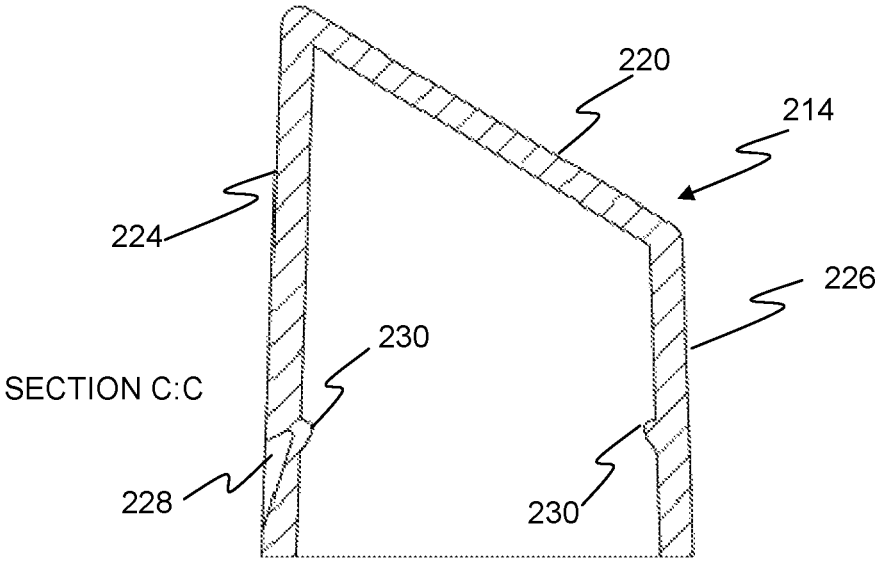
FIG. 7C is a section view depicting the cover of FIG. 7A.

FIGS. 7A-7C depict a cover 214, according to an embodiment. Cover can be configured to engage with actuator 202 as depicted in FIG. 4D. Cover 214 can comprise a front surface 220, side surfaces 222, bottom surface 224 and top surface 226.

Front surface 220 can comprise a translucent or transparent material. In embodiments, each of side surfaces 222, bottom surface 224 and top surface 226 can comprise the same material as front surface 220. Any of side surfaces 222, bottom surface 224 and top surface 226 can comprise alternative materials, including opaque materials. For example, in an embodiment, only front surface 220 enables transmission of light from behind cover 214. In embodiments, front surface 220 can be angled relative to bottom surface 224 and top surface 226, such that identified 302 can be more easily seen by a user regardless of the angle of the toggle 200. Front surface 220, for example, can be arranged at an angle of about 120° relative to top surface 226.

Cover 214 can comprise inward-facing protrusions 230 configured to slideably engage with grooves 218 of actuator 202. Cover 214 can further comprise slot 228, defined in bottom surface 224. Slot 228 can be configured enable insert of a finger, tool, or other device to facilitate a prying action to remove cover 214 from actuator 202. In embodiments, slot 228 can comprise an angled depression in bottom surface 224 proximate at least one protrusion 230, such that when pressure is applied to a wall of slot 228, protrusion 230 is urged out of its corresponding groove 218.

Figure 8A:
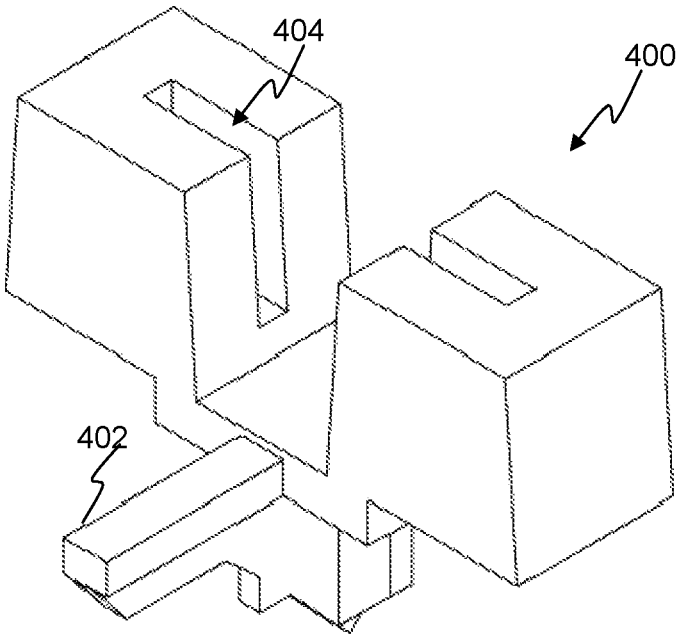
FIG. 8A is a perspective view depicting an insert, according to an embodiment.
Figure 8B:
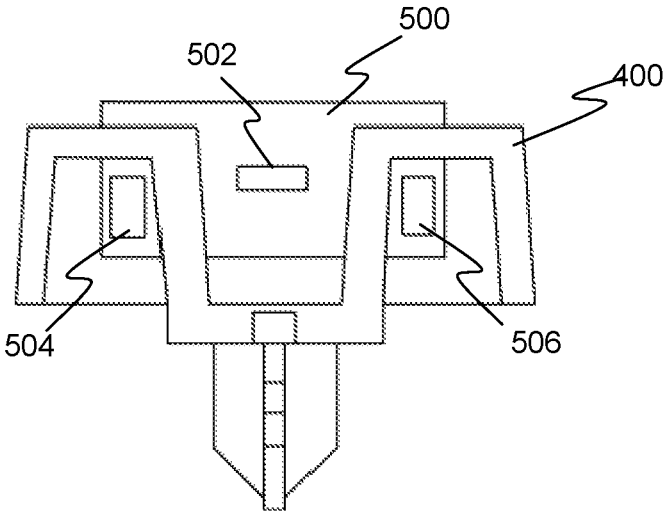
FIG. 8B is a partial sectional view depicting an insert and a lighting element, according to an embodiment.

FIGS. 8A and 8B depict a toggle insert 400 that can be arranged to hold illuminating element 500. Toggle insert 400 can comprise pin 402 configured to engage with actuator 202 as depicted in FIG. 4D, such as by interfacing with a groove or other opening presented within pivot pin 206. Toggle insert 400 can therefore comprise part of switch engagement portion 204 of toggle 200. Toggle insert 400 can further comprise slot 404 configured to receive illuminating element 500.

Illuminating element 500 comprise a light emitting diode (LED) or other light source capable of generating light without causing excess power draw or heating of switch 100. Illuminating element 500 can draw power from an independent battery or other power source in embodiments. In embodiments, illuminating element 500 can be electrically coupled to terminals by one or more conductive traces (not shown) to draw power from the circuit controlled by switch. Illuminating element 500 can comprise a circuit board including power terminals 504 and 506, and LED 502.

Figure 9:
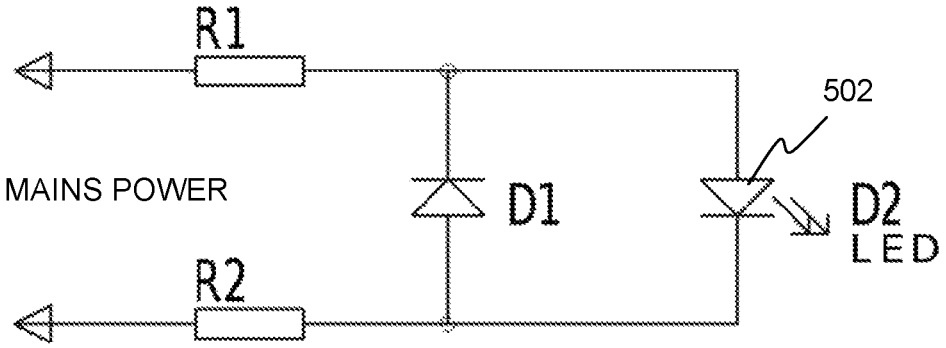
FIG. 9 is a schematic view depicting an electrical circuit, according to an embodiment.

FIG. 9 depicts a wiring diagram of a circuit that can be provided on illuminating element 500, according to one embodiment. Each of terminals 504 and 506 can be connectable to mains power, for example, a 120V alternating current (AC) line, though other mains power configurations can be supported by embodiments. Each of terminals 504 and 506 can be electrically coupled to one of resistors R1 and R2, which can be 162 Ω, 0.25 W resistors with 0.5% tolerance, in one embodiment. LED 502, can be electrically coupled to diode D1, which can be a 1 kV recovery rectifier diode, such as an 1N4007 diode in one embodiment. LED 502 can comprise a 3.2V LED in embodiments.

In embodiments, illuminating element 500 can comprise a multi-element LED, such as the red-green-blue (RGB) LEDs described in U.S. Pat. No. 8,339,058 to Simmers, or other light source capable of emitting light of various colors. In embodiments, illuminating element 500 can be factory configured to display a specific color. In embodiments, switch 100 can include a configuration mechanism adapted to enable user selection of the color or intensity of illuminating element 500. In an embodiment, the configuration mechanism can comprise one or more switches, dials, or jumpers, enabling a user to determine whether illuminating element 500 will be illuminated, and if so the relative intensity of each element of a multi-element LED in order to determine the color. In an embodiment, the configuration mechanism can comprise a wired or wireless connection to a control device (such as a computer, mobile phone, table, remote control, or other device) adapted to send control signals that are interpreted by configuration mechanism to modify the operating parameters of illuminating element 500.

In embodiments, toggle 200 and tile 300 can be constructed of hard plastic or other material suitable to allow operation of switch 100. In embodiments, all or parts of toggle 200 and tile 300 can be opaque, translucent, or transparent, in order to allow light emitted from illuminating element 500 to be seen through all or a portion of toggle 200 and tile 300. Switch body 102 can be constructed of a variety of materials as are generally known in the art for the construction of electrical switches.

Figure 10A:
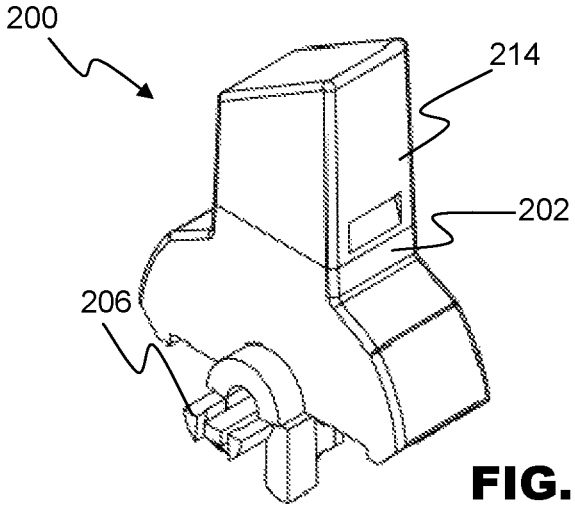
FIG. 10A is a perspective view of a toggle, according to an embodiment.
Figure 10B:
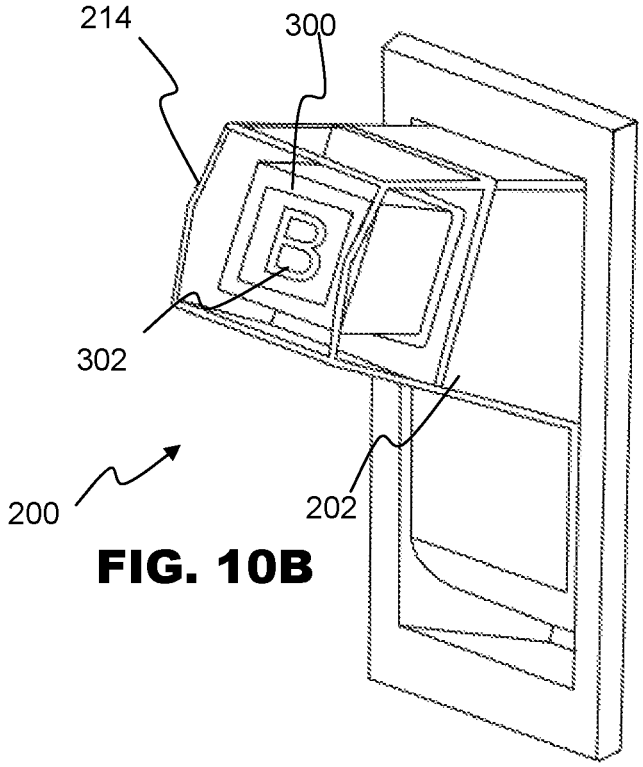
FIG. 10B is a perspective view of a toggle, according to an embodiment.
Figure 10C:
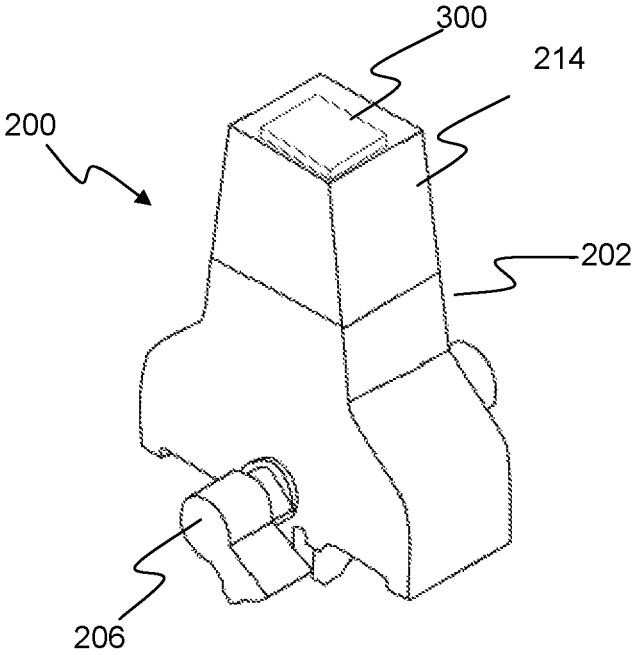
FIG. 10C is a perspective view of a toggle, according to an embodiment.

FIGS. 10A-10C depict various embodiments of toggles 200 comprising covers 214. While switch 100 has been depicted and described as a toggle switch, in embodiments of the present disclosure switch 100 can be configured as a rocker switch, dimmer switch, push button switch, or other electrical switch configuration known in the art.

In embodiments, one or more switches 100 can be provided in a kit comprising multiple interchangeable tiles 300, such that the identifier 302 displayed on switch 100 can be selected when the switch is installed. For example, in one embodiment, a kit can comprise a single switch 100, or toggle 200, and multiple tiles 300. In embodiments, a kit can comprise multiple switches arranged in a gang panel configuration (such as a one-, two-, three-, or higher gang switch) and multiple identifiers.

In embodiments, tiles 300 can be provided in sets based on commonly grouped switch types. For example, a set can include identifiers for common household rooms such as kitchen, living room, dining room, and bedroom. Other sets can include identifiers for example, for overhead lights, floor lights, or audio appliances. Tiles 300 can further be provided in sets corresponding to the alphabet of the English language (or other languages), Arabic numbers (1-10) or with a combination of colors, patterns, shapes or other designs.

In use, tiles 300 can provide an identifier related to the electrical circuit controlled by switch 100, such that the user can more easily distinguish the purpose of multiple switches 100 within a single area.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A toggle assembly for an electrical switch comprising a switch body including a contact assembly configured to control an electrical circuit, the toggle assembly comprising:

an illuminating element comprising a circuit board comprising a light emitting diode;

a switch engagement portion proximate and operably coupled to the switch body at a rear end of the toggle assembly, such that a movement of the toggle assembly from a first position to a second position is mechanically communicated to the contact assembly, the switch engagement portion comprising a toggle insert adapted to receive the illuminating element and to engage with a rear portion of an actuator portion;

wherein the actuator portion is elongated between the switch engagement portion and a front end of the toggle assembly enabling a user to pivot the toggle assembly from the first position to the second position;

an interchangeable tile removably coupleable to the actuator portion at the front end of the toggle assembly, the interchangeable tile comprising a front surface depicting an identifier, the interchangeable tile at least partially comprising a light-transmitting material, such that a light generated by the illuminating element can be seen at the front surface of the interchangeable tile when the interchangeable tile is coupled to the actuator portion; and a cover adapted to be removably coupleable about a front portion of the actuator portion, such that the interchangeable tile is arranged within the cover behind a front surface of the cover when the cover is coupled to the actuator portion;

wherein the front surface of the cover is comprised of a light-transmitting material.

2. The toggle assembly of claim 1, wherein a top surface, a bottom surface, a right side surface and a left side surface of the cover are comprised of an opaque material.

3. The toggle assembly of claim 1, wherein the front surface of the cover is connected to a bottom surface of the cover that extends further forward from the actuator portion than a top surface of the cover, such that the front surface of the cover is presented at an upward facing angle when the cover is coupled to the actuator portion.

4. The toggle assembly of claim 1, wherein the front surface of the interchangeable tile is presented at an upward facing angle when the interchangeable tile is coupled to the actuator portion.

5. The toggle assembly of claim 1, wherein the interchangeable tile comprises a connection mechanism at a rear surface of the interchangeable tile and the actuator portion comprises a receiving mechanism at a front surface of the actuator portion; and further wherein the connection mechanism and the receiving mechanism are configured to provide removable fixation between the interchangeable tile and the actuator portion.

6. The toggle assembly of claim 5, wherein the connection mechanism comprises a rearward-directed pin, and the receiving mechanism comprises a slot of a diameter sufficient to receive the pin.

7. The toggle assembly of claim 5, wherein the connection mechanism comprises a rearward-directed threaded screw, and the receiving mechanism comprises a threaded bore configured to receive the screw.

8. The toggle assembly claim 5, wherein the connection mechanism comprises one or more flanges extending along an axis parallel to the front surface of the connection mechanism, and the receiving mechanism comprises one or more grooves configured to receive the one or more flanges.

9. The toggle assembly of claim 1, wherein the illuminating element comprises a light-emitting diode.

10. The toggle assembly of claim 1, further comprising a conductive trace electrically coupling the illuminating element to the electrical circuit controlled by the electrical switch, such that the illuminating element is powered by the electrical circuit.

11. The toggle assembly of claim 1, further comprising a power source independent of the electrical circuit, such that the illuminating element is powered by the power source.

12. The toggle assembly of claim 1, wherein the actuator portion comprises an opaque material, such that a light generated by the illuminating element cannot be seen through the actuator portion.

13. An electrical switch to control an electrical circuit comprising:

a switch body including:

a first terminal for electrical connection to a first lead of the electrical circuit, a second terminal for electrical connection to a second lead of the electrical circuit, a contact assembly including:

a contact point electrically coupled to the first terminal, and a lever arm electrically coupled to the second terminal, the lever arm manipulable to selectively contact the contact point;

a toggle assembly including:

an illuminating element comprising a circuit board comprising a light emitting diode, a switch engagement portion proximate and operably coupled to the switch body at a rear end of the toggle assembly, such that when the toggle assembly is in a first position the lever arm is not in contact with the contact point, and when the toggle assembly is in a second position, the lever arm is in contact with the contact point, the switch engagement portion comprising a toggle insert adapted to receive the illuminating element and to engage with a rear portion of an actuator portion;

wherein the actuator portion is elongated between the switch engagement portion and a front end of the toggle assembly enabling a user to pivot the toggle assembly from the first position to the second position;

an interchangeable tile removably coupleable to the actuator portion at the front end of the toggle assembly, the interchangeable tile comprising a front surface depicting an identifier, the interchangeable tile at least partially comprising a light-transmitting material, such that a light generated by the illuminating element can be seen at the front surface of the interchangeable tile when the interchangeable tile is coupled to the actuator portion, and a cover adapted to be removably coupleable about a front portion of the actuator portion, such that the interchangeable tile is arranged within the cover behind a front surface of the cover when the cover is coupled to the actuator portion;

wherein the front surface of the cover is comprised of a light-transmitting material.

14. The electrical switch of claim 13, wherein the identifier indicates a property of the electrical circuit controlled by the electrical switch.

15. The electrical switch of claim 13, wherein the interchangeable tile comprises a connection mechanism at a rear surface of the interchangeable tile and the actuator portion comprises a receiving mechanism at a front surface of the actuator portion; and further wherein the connection mechanism and the receiving mechanism are configured to provide removable fixation between the interchangeable tile and the actuator portion.

* * * * *